US005097679A

United States Patent [19]

Johnson et al.

[11] Patent Number: 5,097,679

[45] Date of Patent: Mar. 24, 1992

[54] SCREW IT TOGETHER JEWELRY

[76] Inventors: Beverly L. Johnson, 11926 W. 32nd Pl., Wheat Ridge, Colo. 80033; Nancy A. Bebo, 10974 W. Maryland Ave., Lakewood, Colo. 80232

[21] Appl. No.: 625,142

[22] Filed: Dec. 10, 1990

[51] Int. Cl.[5] ..... A44C 25/00

[52] U.S. Cl. ..... 63/2; 63/23; 63/29.1

[58] Field of Search ..... 63/2, 13, 12, 14.6, 63/20, 23, 29.1

[56] References Cited

U.S. PATENT DOCUMENTS

| | | | |
|---|---|---|---|
| 529,184 | 11/1894 | Oppenheimer | 63/20 X |
| 1,160,723 | 11/1915 | Lander | 63/29.1 |
| 1,864,371 | 6/1932 | Prussian | 63/29.1 |
| 2,316,225 | 4/1943 | Hoffman et al. | 63/29.1 |
| 3,504,507 | 4/1970 | Ferro | 63/12 |
| 4,220,018 | 9/1980 | Chuard | 63/29.1 |
| 4,259,850 | 4/1981 | Calieu | 63/13 |
| 4,353,225 | 10/1982 | Rogers | 63/29.1 X |
| 4,519,220 | 5/1985 | Burrell | 63/23 X |
| 4,765,154 | 8/1988 | Mario | 63/23 |
| 4,781,036 | 11/1988 | Erickson | 63/12 |
| 4,783,974 | 11/1988 | Hernandez | 63/2 |

FOREIGN PATENT DOCUMENTS

| | | | |
|---|---|---|---|
| 201454 | 1/1986 | European Pat. Off. | 63/12 |
| 588502 | 5/1925 | France | 63/2 |
| 650144 | 1/1929 | France | 63/2 |

*Primary Examiner*—Rodney M. Lindsey
*Assistant Examiner*—Jerry Redman

[57] ABSTRACT

A complete and universal method of interchangeability for all types of jewelry, in which ornamental jewelry base unit pieces with threads embodied therein (5), into which can be received the threaded decorative screw attachment (6), with charms, stones, decorations, ornaments, gems, etc. attached at a swivel point (7), being of undetermined sizes, shapes, and materials dependent upon the design application employed.

4 Claims, 4 Drawing Sheets

SCREW IT TOGETHER JEWELRY

BACKGROUND-FIELD OF INVENTION

This invention relates to jewelry, specifically to the interchangeability of pieces by a screw mechanism.

BACKGROUND-DESCRIPTION OF PRIOR ART

Consumers have always had a need for more versatile use of jewelry for their investment dollar. One means of accomplishing this end, is with the use of interchangeable jewelry pieces.

A few inventors in the past have attempted to allow more consumer versatility in jewelry by creating necklace charm/ornament holders, spacer beads, and in one instance a clutch and breakaway mechanism for interchangeability.

A common practice in the market place to facilitate the wearing of one or more charms/ornaments was the charm holder as an attachment to a necklace. This enabled the wearer to change charms as chosen by removing or adding pieces on the charm holder. However, this provided versatility for necklaces only and if more than one ornament was placed on the holder, they would naturally all fall to the lowest point of gravity.

Another common practice to provide an even spacing of charms/ornaments were the use of spacer beads on the neck chain itself or the charm holder mentioned above. This tended to solve the problem of a member of charms clumping in a group on the chain or charm holder, and provided a more aesthetic presentation, but limited versatility.

U.S. Pat. No. 4,783,974 to Hernandez (1988) discloses a method to interchange ornaments for earrings and necklaces using a clutch-breakaway system separating at one pound or less of pressure, however this type of mechanism could be disengaged easily creating a probability of loosing the jewelry pieces.

All attempts to provide the consumer with a method of interchangeability for jewelry heretofore, suffer a number of disadvantages:

(a) The lack of a complete and universal method of interchangeability that provides functionality, versatility, and aesthetic presentation.

(b) Methods to date fail to provide an uniform, all encompassing system applicable to all types of jewelry (pins, necklaces, earrings, bracelets, etc.)

(c) If the consumer chooses to use more than one charm/ornament on a necklace using the charm holder or spacer beads, this results in a cluttered presentation.

(d) Methods available to the consumer to date provide only limited creativity.

(e) An interchangeable mode of operation of the clutch-breakaway type, would facilitate the possibility of having pieces detached with a very minimal pulling effort resulting in loss of pieces and the consumers investment in the jewelry.

OBJECTS AND ADVANTAGES

Accordingly, several objects and advantages of this invention are:

(a) To provide a unique method of interchangeability for all types of jewelry.

(b) To provide interchangeable jewelry that is functional and has a neat, uniform and pleasing aesthetic presentation.

(c) To provide the consumer with a functional method of versatility in interchangeable jewelry requiring a limited number of chosen charms, decorations, ornaments, gems, etc.

(d) To provide a method that maximizes the investment dollar.

(e) To provide an easy method of operation for interchangeability using female and male threaded pieces.

(f) To provide a mode of operation that safely secures the charms, decorations, ornaments, gems, etc. to base units preventing possible loss.

(g) To provide the consumer the freedom to explore and create their own unique jewelry.

(h) To provide a functional method that is conducive tp varied design applications, for daily, business, evening, or any situation.

(i) To provide versatility to the manufacturer in a wide variety of marketable jewelry.

(j) To provide the manufacturer the option of use of a wide scope of materials (precious metals, alloys, plastics, stones, natural elements, etc.)

(k) In providing the manufacturer with versatility in items and materials, costs can be varied and controlled dependent upon the targeted market.

Within the development of a complete and universal method of interchangeability and varied design configurations and applications of jewelry base unit pieces, we can provide the consumer of all ages a wide variety of jewelry at different cost levels. Further objects and advantages of this invention will become apparent from consideration of the drawings and ensuing description of it.

DRAWING FIGURES

Reference is made to the accompanying drawings which form a part hereof, the figures of which are described as follows:

FIG. 1*a* is a typical jewelry barrel screw

FIG. 1*b* is a modified screw application (Note: 1*a* or 1*b* will be used dependent upon manufacturability of materials used)

FIGS. 2–12 are possible applications and configurations for various type of jewelry using one or more screw-it-together charms, stones, decorations, ornaments, gems, etc. attached by a male-female threaded mechanism to necklace, pin, earring, bracelet, etc. base units; being of costume, semi-precious or precious stones and metals or plastics. (For illustration purposes only, the female portion of the barrel screw or the female threads that are part of the die, are contained in the jewelry base units; and the male portion of the barrel screw or threads as part of a more decorative attachment (FIG. 1*b*), are contained as part of the interchangeable charms, stones, decoration, ornaments, gems, etc., of all the figures that follow. However, this configuration could be reversed).

DRAWING REFERENCE NUMERALS

Figure 1A:
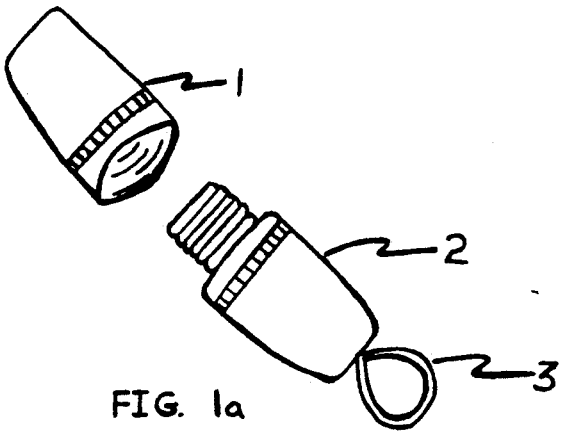

1: Female portion of a typical jewelry barrel screw

2: Male portion of a typical jewelry barrel screw

3: Charms, stones, decorations, ornaments, gems, etc. attached here

5: Female threads die cast in the jewelry base unit

6: Male threads as part of a more decorative die screw-in attachment being of undetermined size and shape 7: Charms, stones decorations, ornaments, gems, etc. attached here 8: Neck chain 10: Neck chain channel of the Bar Type Necklace base unit 12: Bar Type Necklace base unit containing the female portions of the barrel screws or the threads as parts of the die, located in the lower side to screw in one or more charms, stones, decorations, ornaments, gems, etc. (For purposes of illustration, this figure has 2 screw placements)

14: Female portion of a barrel screw or the threads as part of the die contained in the Bar Type Necklace base unit 16: Female portion of a barrel screw or the threads as part of the die contained in the Bar Type Necklace base unit 18: Male portion of a barrel screw ot the threads as part of a more decorative piece with a charm, stone, decoration, ornament, gem, etc. to be attached to the Bar Type Necklace base unit 20: Male portion of a barrel screw or the threads as part of a more decorative piece with a charm, stone, decoration, ornament, gem, etc. to be attached to the Bar Type Necklace base unit 22: Chain channel 24: Female screw threads contained in the Bar Type Necklace base unit 26: Female screw threads contained in the Bar Type Necklace base unit 28: Female screw threads contained in the Bar Type Necklace base unit 30: Female screw threads contained in the Bar Type Necklace base unit 32: Chain channel 34: Male threaded portion of the screw attached to the Bar Type Necklace base unit 36: Charm, stone, decoration, ornament, gem, etc. attached here 38: Neck chain 40: V-shaped Necklace base unit containing the female portion of a barrel screw or the threads as part of the die, located on the lower side to screw in one charm, stone, decoration, ornament, gem, etc.

42: Female portion of a barrel screw or the threads as part of the die, contained in the V-shaped Necklace base unit 44: Male portion of a barrel screw or the threads as part of a more decorative piece with a charm, stone, decoration, ornament, gem, etc. to be attached to the V-shaped Necklace base unit 46: Neck chain 48: Heart shaped Necklace base unit containing the female portion of a barrel screw or the threads as part of the die, located on the lower side to screw in a charm, stone, decoration, ornament, gem, etc.

50: Female portion of a barrel screw or the threads as part of the die, contained in the Heart shaped Necklace base unit 51: Male portion of a barrel screw or the threads as part of a more decorative piece with a charm, stone, decoration, ornament, gem, etc. to be attached to the Heart shaped Necklace base unit 52: Pin base unit containing the female portions of the barrel screws or the threads as part of the die, located in the lower side to screw in one or more charms, stones, decorations, ornaments, gems, etc. (For purposes of illustration, this figure has 3 screw placements)

54: Female portion of a barrel screw or the threads as part of the die, contained in the Pin base unit 56: Male portion of a barrel screw or the threads as part of a more decorative piece with a charm, stone, decoration, ornament, gem, etc. to be attached to the Pin base unit 58: Pin base unit 60: Pin clasp 62: Male threaded portion of the screw with a charm, stone, decoration, ornament, gem, etc. attached to the Pin base unit 64: Earring base unit containing the female portion of a barrel screw or the threads as part of the die, located on the lower side to screw in a charm, stone, decoration, ornament, gem, etc.

66: Earring base unit containing the female portion of a barrel screw or the threads as part of the die, located on the lower side to screw in a charm, stone, decoration, ornament, gem, etc.

68: Male portion of a barrel screw or the threads as part of a more decorative piece with a charm, stone, decoration, ornament, gem, etc. to be attached to the Earring base unit 70: Earring base unit with the charm, stone, decoration, ornament, gem, etc. attached 72: Earring back (Note: the pierced post is shown in this application, however the clip style can also be used)

74: Earring post

76: Bracelet base unit containing the female portions of the barrel screws or the threads as part of the die, located in the lower side to screw in one or more charms, stones, decorations, ornaments, gems, etc. (For purposes of illustration, this figure has 5 screw placements)

78: Male threaded portions of the screws for attachment of charms, stones, decorations, ornaments, gems, etc. attached to the bracelet base unit.

DESCRIPTION OF INVENTION-FIGS. 1 to 12

Figure 1B:
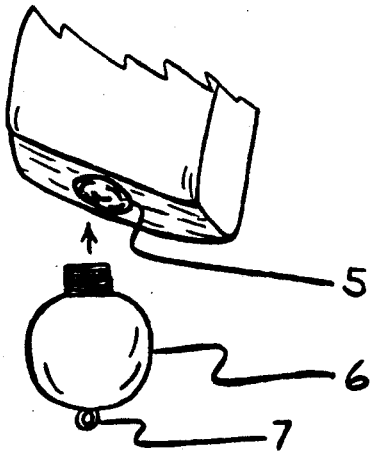
Figure 2:
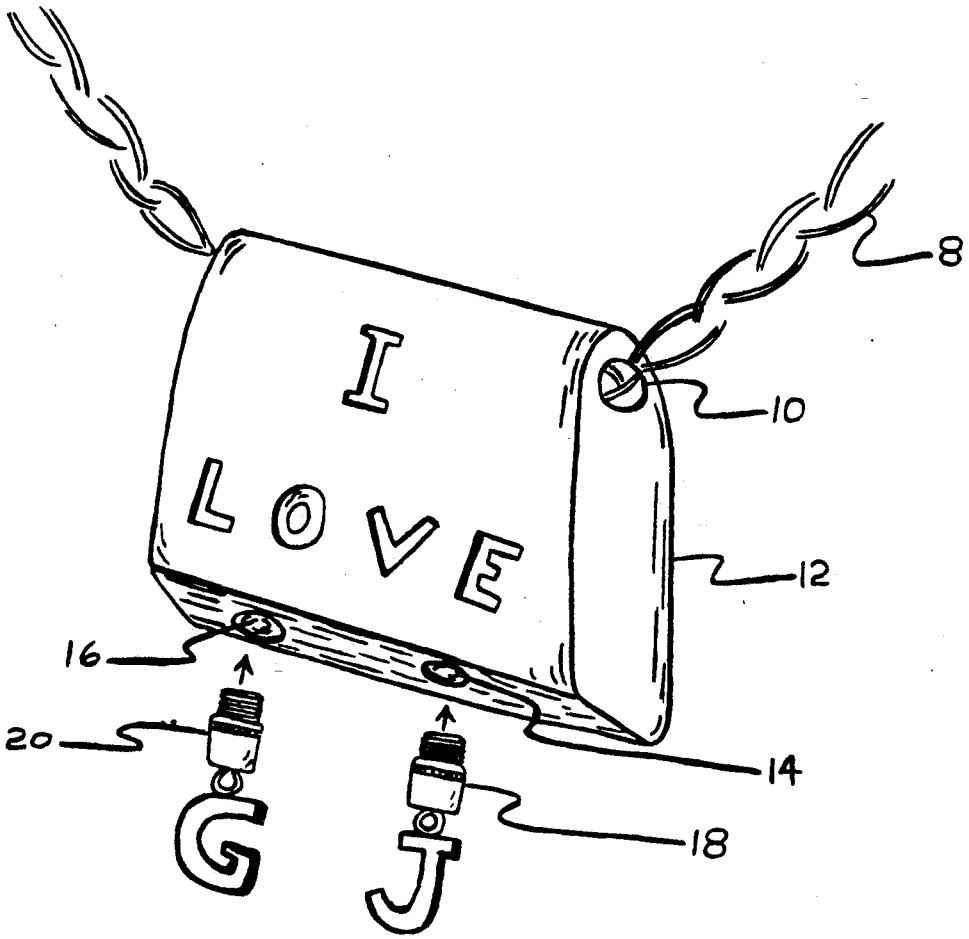
FIG. 2 shows a Bar Type Necklace base unit, front view

FIG. 1*a* and 1*b* are jewelry screw application to be embodied within the example base unit pieces; 12, 40, 48, 52, 64, 66 and 76 that follow. FIG. 1*a* is a typical jewelry barrel screw with a female portion 1, an a male threaded portion 2 containing a swivel attachment point 3. FIG. 1*b* is a modified screw application which provides a functional yet more aesthetic presentation for the base unit pieces and screw-in attachments. The female threads 5, are die cast into the ornamental jewelry base unit and the male threads are part of a more decorative screw attachment 6, being of undetermined size and shape depending upon the design application employed. The configuration of the female threads embodied in the base unit, and the male threads as part of the screw-in portion shown in FIG. 1*b*, could be reversed.

Therefore, the male threads could be die cast as part of the ornamental jewelry base units and the female threads would become part of the decorative unit, 6. Contained in the screw-in unit 6, is a swivel attachment point 7. Charms, stones, decorations, ornaments, gems, etc. will be attached at points 3 and 7.

FIGS. 2, 6, 7, 8, 10, and 12 are possible applications and configurations of designs for various types of jewelry using one or more screw-it-together charms, stones, decorations, ornaments gems, etc.

Figure 3:
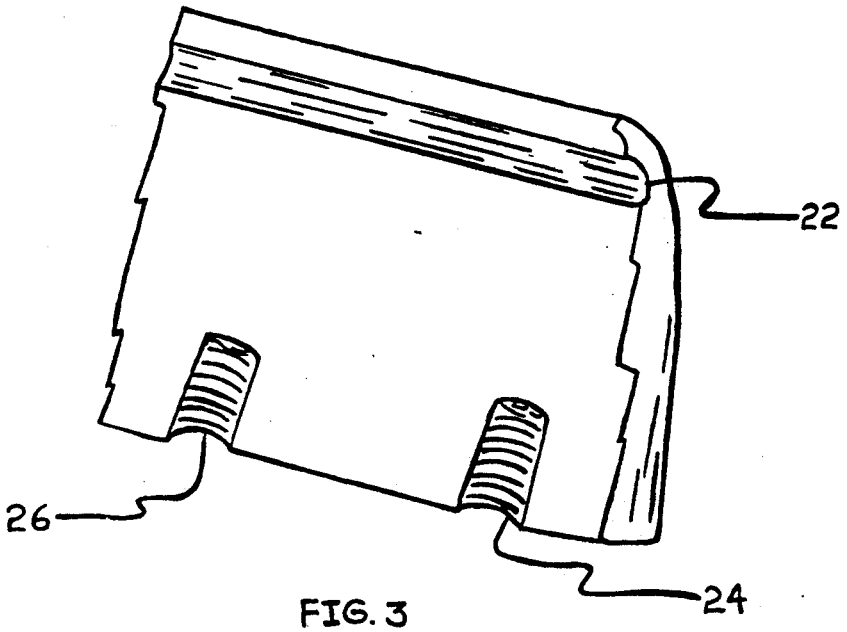
FIG. 3 shows the Bar Type Necklace base unit, sectional view
Figure 4:
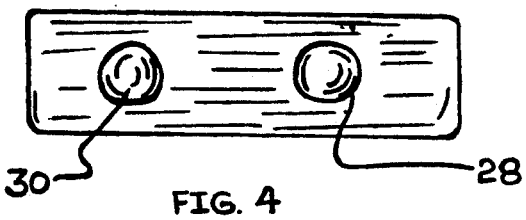
FIG. 4 shows the Bar Type Necklace base unit, bottom view
Figure 5:
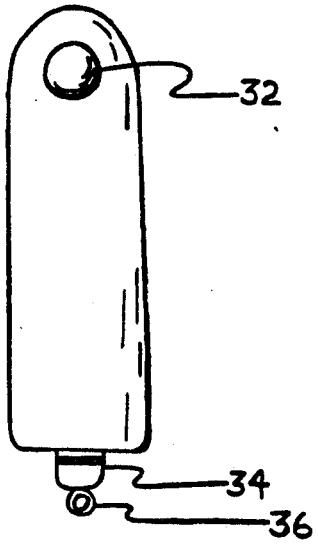
FIG. 5 shows the Bar Type Necklace base unit, side view

FIG. 2, 3, 4, and 5 show the front, sectional, bottom and side views of a Bar design necklace base unit. Contained in the Bar base unit 12, is the neck chain channel 10 (FIG. 2), 22 (FIG. 3), and 32 (FIG. 5) in which the neck chain 8 is positioned. The chain channel application could be abandoned and the neck chain attachment method shown in FIG. 6 could be adapted, obviously dependant upon the specific design. Also contained in the Bar base unit 12, is the female portion of the barrel screw 1, or the threads as part of the die 5, located in this illustration on the lower side at points 14 and 16. These threading points are also shown in FIG. 3 and 4, the sectional and bottom view of the Bar Type necklace. In considering the design of a particular piece, the number of screw placement points and the male/female configuration could vary. In this instance to illustrate the functionality and safety of this method of interchangeability, a male portion of a barrel screw has a letter charm attached, 18 and 20 to be screwed into points 14 and 16 of the Bar base unit 12. Also, the male threaded piece 34, with a swivel attachment point 36, are connected to the base unit as shown in FIG. 5, side view. A more decorative application could be employed, as mentioned in the description of FIG. 1*b* above, depending upon the design and varying materials used.

Figure 6:
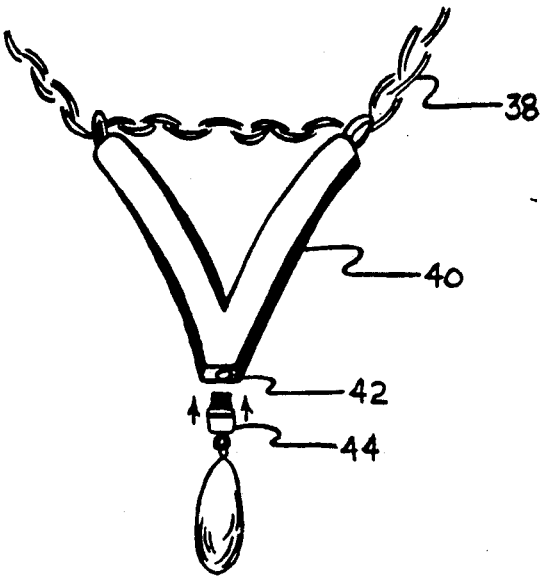
FIG. 6 shows a V-shaped Necklace base unit, front view

FIG. 6 illustrates another possible adaptation of this invention in the form of a V-shaped necklace base unit that is more conductive but not limited to the use of precious stones and metals. The V-shaped base unit 40, has the neck chain 38, passing thru hoops on the upper portions of the "V" or could be directly attached at those points depending upon the design. The female threads 42, are embodied in the lower portion of the V-shaped base unit. The male threaded piece with a gem attached 44, can be safely secured in to the base unit and can not be pulled off easily, therefore avoiding possible loss.

Figure 7:
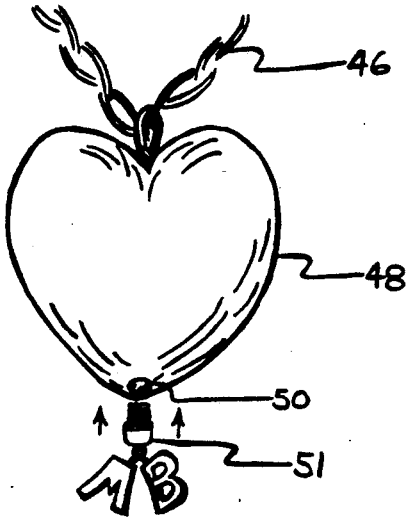
FIG. 7 shows a Heart shaped Necklace base unit, front view

FIG. 7 application of this unique method of Screw-It-Together Jewelry, is a Heart Shaped necklace base unit 48, with neckchain 46 and female threads 50 embodied therein. The male threaded piece with letter charms attached 51, will be screwed into point 50 of the base unit 48. To illustrate the different possibilities of interchangeability, the ornament 51, could be easily unscrewed from base unit 48, and the gem piece 44 of FIG. 6 could be used and attached in the threads 50, of FIG. 7, hence changing the total appearance of the piece.

Figure 8:
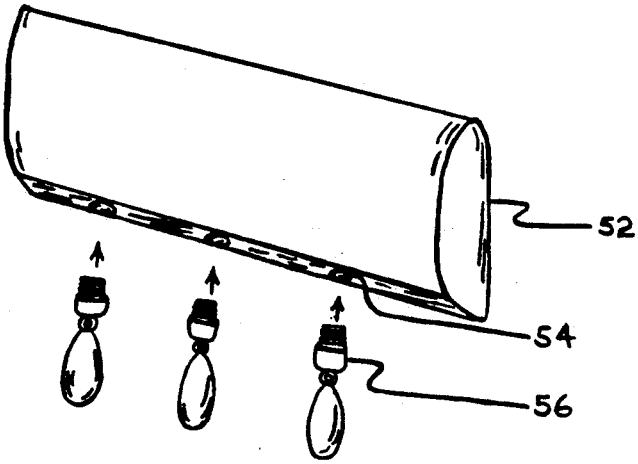
FIG. 8 shows a Pin base unit, front view
Figure 9:
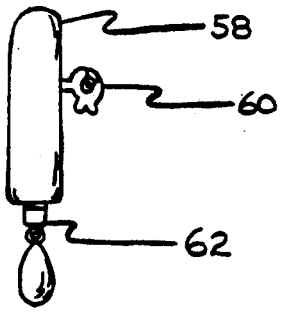
FIG. 9 shows the Pin base unit, side view

Moving on to other types of jewelry, FIG. 8 illustrates a possible application of a pin in a Bar Style design. The pin base unit 52, demonstrates the use of 3 screw placements 54, positioned in a manner which provides a neat and uniform presentation of multiple charms, stones, decorations, ornaments, gems, etc. 56. FIG. 9 shows the side view of the pin base unit 58, with a clasp 60, and the threaded piece with ornament 62, attached.

Figure 10:
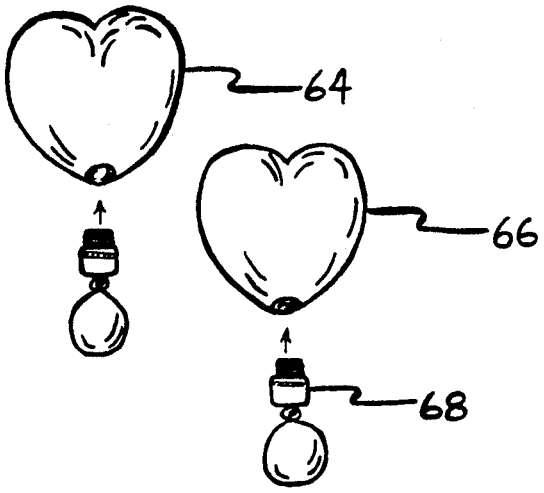
FIG. 10 shows a Pair of earring base units, front view
Figure 11:
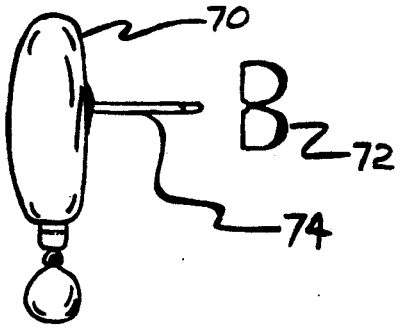
FIG. 11 shows the Earring base unit, side view

In furthering the wide scope of this invention, FIG. 10 shows the front of a pair of earring base units, 64 and 66 with a threaded placement point on the lower edge to receive the screw attachment piece, 68 with a charm, stone, decoration, ornament, gem, etc. For illustration purposes only the male threaded piece with decoration 68, are shown, keeping in mind that the male/female thread configuration of the base units and ornament attachment pieces could be reversed as the design permits. The side view, FIG. 11 shows an earring base unit and attached Screw-It-Together ornament 70, and post 74 and back 72 of a pierced earring application, however note that a clip style could also be employed.

Figure 12:
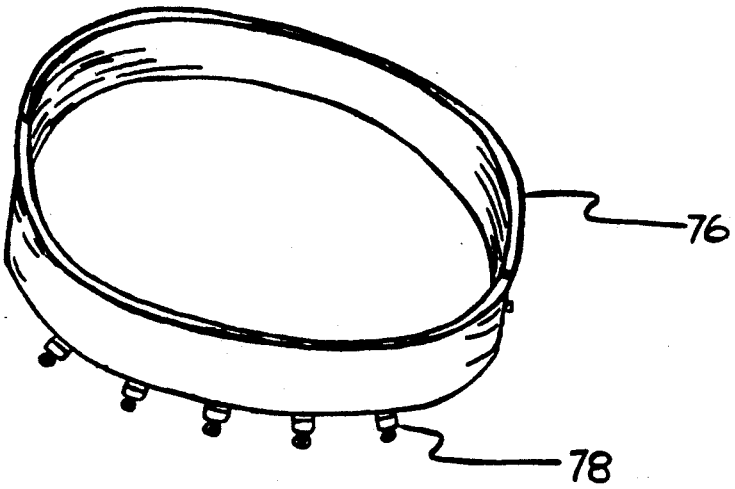
FIG. 12 shows a Bracelet base unit, front view

FIG. 12 expands the scope of this invention to even other types of jewelry by illustrating a bracelet base unit 76 with 5 (five) uniformly placed screw attachment points, 78. This clearly demonstrates a method in which the charms, stones, decorations, ornaments, gems, etc. have an uncluttered presentation.

From the descriptions above we have illustrated a number of design configurations of various types of jewelry and a number of advantages of Screw-It-Together Jewelry become evident:

(a) A unique method of interchangeability for all types of jewelry, that is functional and has a neat, uniform, and pleasing aesthetic presentation.

(b) A functional method of versatility in interchangeable jewelry requiring a limited number of chosen charms, stones, decorations, ornaments, gems, etc. of varied materials, therefore maximizing the investment dollar and providing the consumer of all ages a wide variety of jewelry and different cost levels.

(c) An easy, safe method of operation for interchangeability using female and male threaded pieces.

(d) To provide the consumer the freedom to explore and create their own unique jewelry.

(e) A functional method of interchangeability that provides versatility to the manufacturer in varied designs, materials, and costs.

OPERATION OF INVENTION

As typified in the descriptions of the possible applications and configurations of the basis of this invention illustrated in FIG. 1*b*, this method of interchangeability for all types of jewelry has an easy mode of operation. The manner of using the base unit jewelry and ornament attachment pieces of undetermined size, shape, materials, and design for interchangeability, consist of: namely taking an ornament attachment piece of particular design with male or female threads (ref. 6 of FIG. 1*b*), having a charm, stone, decoration, ornament, gem, etc. attached at point 7, and simply screwing it into the various jewelry base units 5 containing the mated receiving male/female threads. To illustrate this mode of operation of interchangeability using the following as examples to show movement between jewelry base unit pieces. This could be as simple as taking the gem attachment unit of example application of earrings FIG. 10, ref. 68, and screwing them into the Necklace Bar base unit of example application FIG. 2 at securing points 14 and 16, thusly creating versatility in appearance. The uniqueness of creativity and versatility of this mode of operation is further expanded by using for example, the Bracelet base unit with 5 attachment points in FIG. 12, and then screwing in charms, stones, decorations, ornaments, gems, etc. ref. 18, 20, 44, (1 of)6, (1 of)68.

SUMMARY, RAMIFICATIONS, AND SCOPE

Accordingly, the reader will see that Screw-It-Together Jewelry's easy, secure, functional mode of operation of taking an ornament attachment piece with male/female threads having a charm, stone, decoration, ornament, gem, etc. attached and simply screwing it into the various jewelry base unit pieces containing the receiving male/female threads, is one in which provides a new and unique means of interchangeability and varied design configurations and applications. Furthermore, Screw-It-Together Jewelry has the additional advantages in that:

- it provides a unique method of interchangeability for all types of jewelry, that is functional and has a neat, uniform, and pleasing aesthetic presentation;
- it provides a functional method of versatility in interchangeable jewelry requiring a limited number of chosen charms, stones, decorations, ornaments, gems, etc. of varied materials, therefore maximizing the investment dollar and providing the consumer of all ages a wide variety of jewelry and different cost levels.
- it allows an easy, safe method of operation for interchangeability using female and male threaded pieces.
- it allows the consumer the freedom to explore and create their own unique jewelry.
- it permits the manufacturer versatility in varied designs, materials and costs.

Although the description above contains many specificities, these should not be construed as limiting the scope of the invention but merely providing illustrations of some of the applications of the embodiments of this invention. For example, because of the simplicity of this mode of operation, it can be used for all types of jewelry of undetermined size, shape, materials, and designs, but the invention should not be limited by the determination of the male/female thread configuration.

Thus the scope of the invention should be determined by the appended claims and their legal equivalents, rather than by the examples given.

We claim:

1. An ornamental jewelry device comprising of:

an article of jewelry having a threaded female base portion, a threaded male portion having threads at one end and a pivotal loop at an opposite end, the threads of said male portion being threaded into said female base portion, and one or more ornaments are attached to said pivotal loop.

2. An ornamental jewelry device as set forth in claim 1, wherein the pivotal loop is capable of pivoting 360 degrees.

3. An ornamental jewelry device as set forth in claim 1, wherein said article is embodied as a decorative attachment unit.

4. An ornamental jewelry device as set forth in claim 3, wherein more than one female base portion is embodied within said decorative attachment unit and complimentary threaded male portions are attached to said female base portions.

* * * * *